United States Patent [19]

Mikulecky et al.

[11] 4,246,749

[45] Jan. 27, 1981

[54] METHOD OF AND APPARATUS FOR PIECING YARN IN OPEN END ROTOR SPINNING UNITS

[75] Inventors: Karel Mikulecky, Chocen; Jiri Elias, Brandys nad Orlici; Frantisek Burysek, Usti nad Orlici; Stanislav Esner, Usti nad Orlici; Stanislav Skoda, Usti nad Orlici; Miloslav Tyl, Usti nad Orlici; Jan Janousek, Brandys nad Orlici, all of Czechoslovakia

[73] Assignee: Vyzkumny ustav bavlnarsky, Usti nad Orlici, Czechoslovakia

[21] Appl. No.: 29,371

[22] Filed: Apr. 12, 1979

[30] Foreign Application Priority Data

Apr. 21, 1978 [CS] Czechoslovakia ..... 2561-78

[51] Int. Cl.[3] ..... D01H 15/02

[52] U.S. Cl. ..... 57/263

[58] Field of Search ..... 57/263, 301, 302, 304, 57/305, 306

[56] References Cited

U.S. PATENT DOCUMENTS

| | | | |
|---|---|---|---|
| 3,695,017 | 10/1972 | Hori et al. | 57/263 |
| 3,999,362 | 12/1976 | Schulz et al. | 57/263 |
| 4,145,867 | 3/1979 | Kamp | 57/263 |
| 4,166,356 | 9/1979 | Chrtek et al. | 57/302 |

*Primary Examiner*—Donald Watkins

[57] ABSTRACT

A method of and an apparatus for piecing yarn in open end rotor spinning units. The returning of the yarn end into the spinning rotor for piecing is performed in two stages, in the first of which the yarn is stopped immediately upon breakage within the sucking range of the spinning rotor, and is brought immediately thereafter into a withdrawal chamber in which the yarn end is retained. In the second stage the yarn end is separated and deposited in said withdrawal chamber, and the new yarn end is introduced by further reverse motion into the spinning rotor. The apparatus has a withdrawal chamber interposed between the inlet of the withdrawing channel and a cutting mechanism. In one embodiment said chamber is connected to the withdrawing channel, opposite which there is mounted a nozzle connected to a controlled pressure air source. In another embodiment there is provided a nozzle communicating with the withdrawal chamber, said nozzle being connected to a controlled source of underpressure.

4 Claims, 4 Drawing Figures

METHOD OF AND APPARATUS FOR PIECING YARN IN OPEN END ROTOR SPINNING UNITS

The present invention relates to a method of and an apparatus for piecing yarn in open end rotor spinning units. Such method is performed by re-introducing the yarn end, located in a withdrawing channel by an underpressure effect, into a spinning rotor, said yarn end being cut within the withdrawing channel section and the separated yarn end being removed before the reintroducing step.

In open end spinning machines, three systems A, B, and C of removing yarn breakage are known, the position of the yarn end differing in the respective systems.

(A) A method of eliminating yarn breakage is known in which the mechanism for feeding fibrous material and the withdrawing mechanism for the yarn is stopped before stopping the spinning rotor upon machine stoppage. The end of spun yarn, located inside the spinning rotor, is axially tensioned by using suitable means, and upon re-starting the machine, the spinning rotor is started before starting the feeding and withdrawing mechanisms. In the case that the spinning rotor does not develop underpressure itself, the machine functions at operating speed upon restarting the spinning rotor only after engagement of the sucking device.

In a modification of the above known method upon stopping the spinning rotor with engaged sucking device, a certain length of the spun yarn is returned from the withdrawing tube and the end part of the spun yarn is thereupon gripped by a gripping mechanism, said gripping mechanism being released upon restarting the machine before operating the feeding and withdrawing mechanisms.

This method deals only with the piecing process upon a preceding machine stoppage. It cannot be used for eliminating yarn breakages caused during spinning, nor in combination with cleaning the spinning rotor.

(B) In another known method, the yarn end leaves the withdrawing tube upon yarn breakage and is wound onto the bobbin Upon piecing, said end is detected by a special device, gripped and introduced into the spinning unit, whereupon piecing is performed by reverse motion of the winding and withdrawing mechanisms. The direction of rotation of the mechanism is then reversed to the direction necessary for carrying out the normal spinning process.

Beside the fact that the device for performing this method of detecting the yarn end and for reintroducing it into the spinning unit is very complicated per se, particularly when in addition thereto it is combined with cutting the yarn end before piecing, a further additional device for withdrawing the wound bobbin from the winding cylinder and for its return into contact therewith at a precisely defined moment after piecing is indispensably required.

(C) A further known method consists in that upon stoppage of the machine the feeding of fibers into the spinning rotor is stopped first, and upon having spun the fibers from the spinning rotor, the withdrawing rollers and the winding cylinder are stopped in the time in which the yarn end is still subjected to the sucking effect of the rotating spinning rotor, the operation of which is stopped last. Upon starting the machine, said spinning rotor is started first, and thereupon the withdrawing rollers and winding cylinders are simultaneously reversely operated for the purpose of reintroducing the yarn ends into the spinning rotor. Thereupon, fiber feeding is renewed, and simultaneously, the rotation of withdrawing rollers and the winding cylinder is reversed to the direction necessary for the performance of the normal spinning process.

This last mentioned known method is much simpler when compared with the preceding methods and is fully satisfactory in those cases in which upon eliminating a yarn breakage the yarn end need not be cut and the rotor cleaned upon piecing. In cleaning the rotor, however, which is usually performed by blowing pressure air, the yarn end is blown out of the tube, thus making automatic yarn piecing impossible. This is the main disadvantage of this method.

The object of the present invention is to maintain the simplicity of the last-described method with the simultaneous mitigation of its disadvantages upon piecing, in which the yarn end is to be cut and before which the spinning rotor is to be cleaned.

In the method according to the present invention the returning of yarn for piecing is performed in two stages, in the first of which the yarn is stopped immediately after breakage, at first within the sucking range of the spinning rotor and is brought into a withdrawal chamber immediately thereafter, in which the yarn end is retained. In the second stage, the yarn end is separated, the separated end remains in the withdrawal chamber, and a further reverse motion of the yarn is started by which the new yarn end is introduced into the spinning rotor.

In the apparatus for performing the method according to the present invention a withdrawal chamber is connected to the withdrawing channel between the inlet of the withdrawing chamber and the cutting mechanism.

In one advantageous embodiment of the apparatus according to the present invention a nozzle is mounted contrary to said withdrawal chamber, said nozzle being connected to a pressure air source controlled by means of a control mechanism.

In a further suitable embodiment of the apparatus according to the present invention, an underpressure source, controlled by means of a control mechanism, is connected to the withdrawal chamber.

The advantage of the present invention consists in that no extraordinary requirements are put on the attentants, and all required operations are reliably performed.

The particular advantage of the apparatus of the present invention is its simple construction.

The present invention is described in a detailed manner in the following specification and is illustrated in the form of examples in the accompanying drawings in which.

Figure 1:
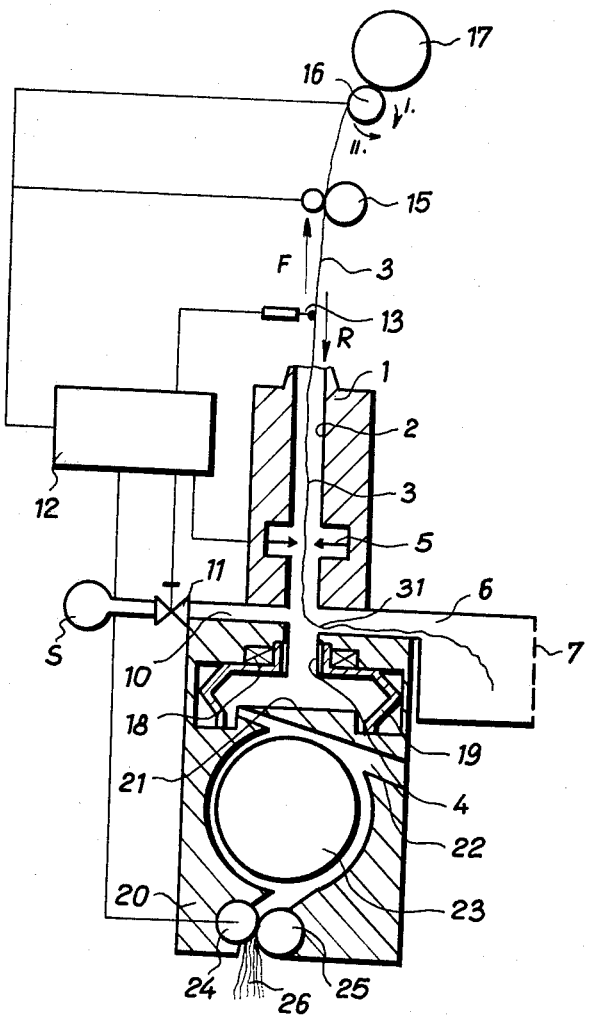
FIG. 1 is a schematic view in vertical section of a first embodiment of the rotor spinning unit of the invention immediately after yarn breakage.
Figure 3:
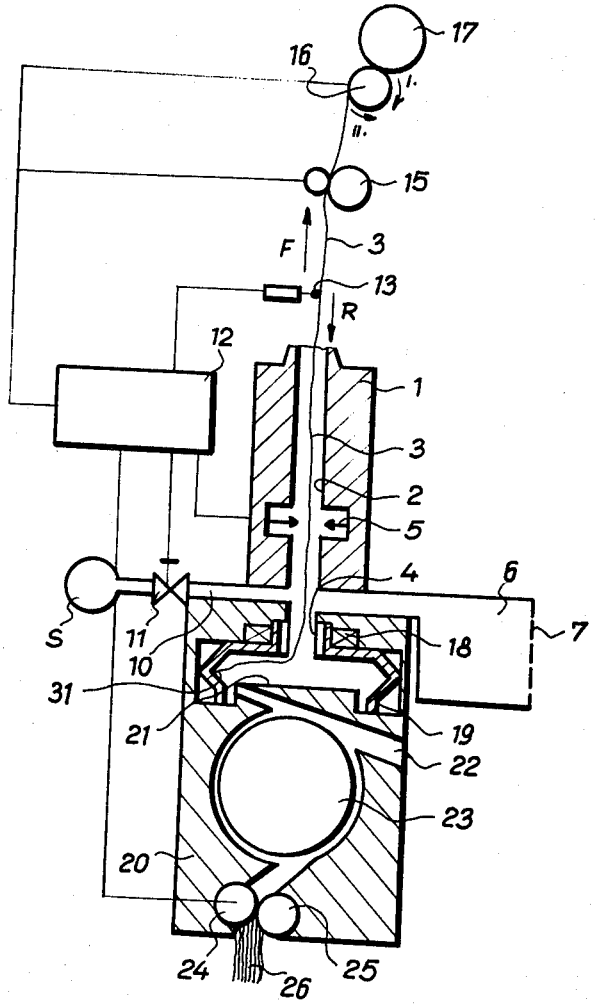
Figure 4:
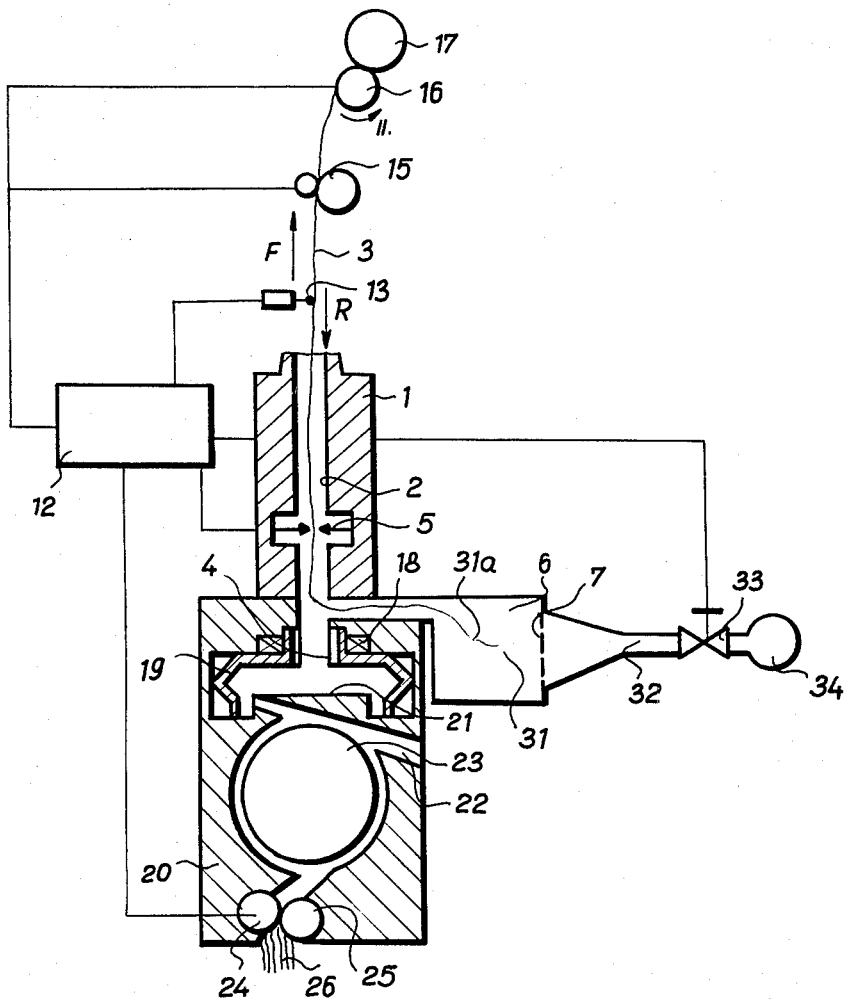

FIG. 3 is a similar view of the apparatus of FIG. 1 illustrating the phase of introducing the yarn end onto the collecting surface of the spinning rotor for piecing; and FIG. 4 is a schematic view in vertical section of a second embodiment of the invention in which the withdrawal chamber is connected to an underpressure source, the figure showing the yarn end being introduced into the withdrawal chamber.

Figure 2:
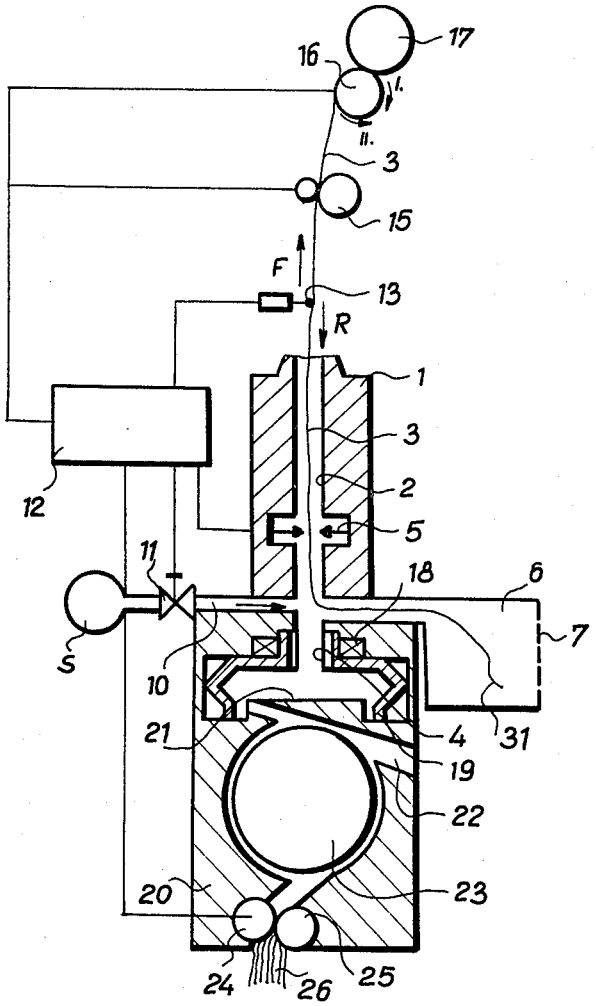
FIG. 2 is a similar view of the apparatus of FIG. 1 but with the yarn end introduced into the withdrawal chamber by means of an air flow, and the cutting mechanism prepared for separating the yarn end.

Turning first to the embodiment of FIGS. 1, 2, and 3, in the body 1 of the spinning unit, there is a withdrawing channel 2, through which yarn 3 with the yarn end 31 passes. Near the inlet 4 of withdrawing channel 2, there is mounted a spinning rotor 19 on bearings 18, the rotor being driven in a known manner (not shown), e.g. from a central electric motor by means of an endless belt and tensioning rollers, or in any other conventional manner. A combing device having a body 20 is disposed upstream of the rotor 19, the body 20 of the combing device having a central projection 21, which extends somewhat into the interior of the rotor. A feeding channel 22 extends through the body 20 of the combing device as shown, channel 22 being open at one end to the ambient atmosphere and extending tangentially of a combing roller 22 which is mounted in the hollow of body 20 of the combing device and is provided with a sawtooth or similar covering. A driven feeding roller 25 is channeled in body 20 of the combing device, there being an idle roller 25 cooperating with roller 24 for condensing silver 26 as it is fed to the combing device. A yarn withdrawal chamber 6 is connected to the withdrawing channel 2 between the inlet 4 and a cutting device 5 located therein downstream of the inlet, one wall of the withdrawal chamber 6 being formed by a screen 7.

A nozzle 10 for the pressure air sent from a source S toward the withdrawal chamber, said source being controlled by a valve 11. All mechanisms of the spinning unit are interconnected with a central driving and control mechanism 12. Mechanism 12 not only controls the valve 11, but is also connected to a feeler 13 which is shown mounted immediately above the withdrawing channel 2. The driving and control mechanism 12 performs its control activity in accordance with a pulse obtained from said feeler 13. In the path of yarn 3 beyond the feeler 13 there are mounted withdrawing rollers 15 and a winding roller 16 which supports and drives the bobbin 17 upon which the yarn is wound. It is to be understood that the feeler 13 may alternatively be mounted in the withdrawing channel 2 downstream of the cutting device 5.

Upon normal operation in the spinning unit shown in FIGS. 1, 2, and 3, silver 26 is fed by feeding rollers 24 and 25 to the surface of combing roller 23, where the fibers are separated by means of the teeth of the covering of combing roller 23. The separated fibers are doffed from the surface of combing roller 23 and are fed through the transporting channel 22 into the spinning rotor 19, where they are deposited at the maximum diameter in ribbon shape, which is spun and withdrawn under simultaneous twist imparting in the form of yarn 3 through the withdrawing channel 2 and past feeler 13 by means of withdrawing roller 15, and are wound onto bobbin 17 by means of the winding cylinder 16.

FIG. 1 shows the rotor spinning unit immediately after yarn breakage, the trailing end of the broken yarn being designated 31. Upon such yarn breakage, the feeler 13 emits an electrical pulse to the driving and controlling mechanism 12, which then stops the feeding of the yarn 3 with its end 31 inside the withdrawal channel 2, as shown. At the same time, the mechanism 12 in response to the signal from feeler 13 stops the yarn withdrawing rollers 15 and the winding cylinder 16. The feeding of fibers from silver 26 by rolls 24 and 25 is also stopped.

After the withdrawal of yarn 3 in the forward direction F has been stopped, the mechanism 12 reverses the direction of driving of rolls 15 and 16 so as immediately to begin the returning of yarn 3 in the rearward direction R. The end 31 of yarn 3, which remained in the withdrawing channel 2, returns immediately. This returning motion of the yarn 3 lasts only for a very short interval, which is sufficient only to introduce end 31 of yarn 3 into the withdrawal chamber 6. In order to prevent the end 31 of yarn 3 from returning into the spinning rotor 19, such end 31 is directed toward the chamber 6 by a jet of pressure air from nozzle 10, upon a command issued by the mechanism 12. The nozzle 10 is disposed opposite the yarn receiving opening of the chamber 6 so that there is established an air flow radially through the chamber 6 and out through the screen 7. The portion of the returned yarn upstream of the cutting device 5 is designated 31*a*. As shown in FIG. 2, portion 31*a* is being blown into the chamber 6.

During such blowing of the portion 31*a* of the yarn into chamber 6, the spinning rotor 19 is cleaned by a cleaning device (not shown) of known construction. The spinning rotor 19 is usually stopped for that purpose, and its rotory motion is started again after the cleaning operation. The rotor 19 is prepared for piecing only upon having gained its operative speed of rotation. During this whole interval, air flows from nozzle 10 into the withdrawing chamber 6 and retains the yarn end portion 31*a* of yarn 3 in chamber 6, thus preventing the pressure air of the means for cleaning the spinning rotor 19 from blowing the yarn end portion 31*a* out of the withdrawing chamber 6 and into the withdrawing channel 2.

As soon as the spinning rotor 19 is prepared for piecing, cutting device 5 is brought into operation, and cuts away the end portion 31*a* of yarn 3. The separated yarn portion 31*a* of yarn 3 is deposited inside the withdrawal chamber 6 and is removed therefrom periodically. Immediately after operation of the cutting device, valve 11 is closed, and the second stop of returning yarn 3 is initiated, as shown in FIG. 3. In such second step, yarn 3 is introduced into rotor 19 and the piecing is performed, whereupon the spinning process is reestablished.

In FIG. 4, there is shown a second embodiment of the rotor spinning unit of the invention, parts thereof which are similar to those shown in FIGS. 1, 2, and 3 being designated by the same reference characters. In the apparatus of FIG. 4, the pressure air source S and the valve 11 are replaced by a duct 32 having a valve 33 and opposed therein, duct 32 being connected at one end to withdrawal chamber 6 beyond the screen 7, the other end of duct 32 being connected to a source of vacuum or underpressure 34. Valve 33 is controlled by pulses emitted by control mechanism 12.

In the embodiment of FIG. 4, the piecing process is performed in the same manner of that above described in connection with FIGS. 1, 2, and 3, with the exception that the end portion 31*a* of yarn 3 is reflected into the withdrawal chamber 6 by underpressure rather than by a pressure from a pressure source. Thus, at the appropriate time in the piecing cycle, the valve 33 is opened upon receipt of a command from mechanism 12, so that air is drawn through the entry passage leading into such chamber carrying with it the yarn end portion 31*a*. The underpressure from source 34 necessary for deflecting yarn end portion 31*a* and its safe introduction into withdrawal chamber 6 must not be lower than the underpressure exerted by rotation of the spinning rotor 19. Upon separating yarn end portion 31*a* by the cutting device 5 and depositing such portion 31*a* in the withdrawal chamber 6, underpressure source 34 is disconnected from chamber 6 by closing valve 33, and the returning of end 31 of yarn 3 for the purpose of piecing is performed in the same manner as that above described in connection with the first embodiment of the invention. Other methods of cancelling the underpressure created by the spinning rotor 19 upon piecing are also possible, as, e.g., by means of a suitably arranged injector, or other similar means.

The method according to the present invention, as well as the apparatus for carrying out such method, preserves the advantage of stopping yarn 3 in the withdrawing channel 2, thus eliminating the necessity of a device for detecting the yarn end for the purpose of introducing it into the spinning unit. Moreover, by dividing the reverse motion of the yarn into two phases it is possible to maintain the yarn in the spinning unit during the cleaning of the rotor, and to carry out the separation of the yarn end portion 31*a* for the purpose of improving the conditions for piecing.

Although the invention is illustrated and described with reference to one preferred embodiment thereof, it is to be expressly understood that it is in no way limited to the disclosure of such a preferred embodiment, but is capable of numerous modifications within the scope of the appended claims.

What is claimed is:

1. In a method of piecing yarn in spinning units for open end rotor spinning which includes reintroducing into a spinning rotor a yarn end located inside a withdrawing channel under an underpressure effect, said yarn end being severed before being reintroduced within the withdrawing channel section, and the severed section thereof being removed, the improvement wherein the reintroduction of yarn for the purpose of piecing is performed in two stages, the first stage comprising: stopping the yarn end within the sucking range of the spinning rotor immediately upon breakage, transporting said yarn end immediately thereupon by a first, shorter reverse motion of the yarn into a withdrawal chamber in which the end of yarn is retained, and the second stage comprising: thereupon separating the end of yarn and withdrawing it by the withdrawal chamber, and thereafter starting a second, longer reverse motion of the yarn by which a new yarn is introduced into the spinning rotor.

2. In an apparatus for piecing yarn in an open end rotor spinning unit having a spinning rotor, a withdrawing channel, means for reintroducing into the spinning rotor a yarn end located inside the withdrawing channel under an under pressure effect, means for severing the yarn within the withdrawing channel section and removing the severed yarn end before reintroducing a fresh yarn end into the spinning rotor, the improvement which comprises a withdrawal chamber, mechanism for performing the reintroduction of yarn for the purpose of piecing in two stages, said mechanism comprising means for stopping the yarn within the sucking range of the spinning rotor in the first stage immediately upon breakage, means for transporting the yarn by a first shorther reverse motion of yarn, means for introducing said yarn end immediately thereupon into the withdrawal chamber in which the said end of yarn is retained, means in the withdrawing channel for thereupon severing the end of yarn in the second stage and for withdrawing it by the withdrawal chamber, means for thereafter starting a second, longer reverse motion of the yarn by which a fresh yarn end is introduced into the spinning rotor, and means providing a connection of the withdrawal chamber with the withdrawing channel between the inlet of the withdrawing channel and the means for severing the yarn end.

3. Apparatus according to claim 2, wherein a nozzle is connected to a pressure air source controlled by a control mechanism, the nozzle being mounted oppositely to the withdrawal chamber.

4. Apparatus according to claim 2, wherein an underpressure source controlled by a control mechanism is connected to the withdrawal chamber.

* * * * *